US005917291A

United States Patent [19]

Soules et al.

[11] Patent Number: 5,917,291

[45] **Date of Patent: *Jun. 29, 1999**

[54] ELECTRODELESS FLUORESCENT LAMP HAVING AN IMPROVED PHOSPHOR DISTRIBUTION ARRANGEMENT AND A METHOD OF MAKING THE SAME

[75] Inventors: Thomas F. Soules, Richmond Heights, Ohio; Judit Szigeti; Gabor Sajo, both of Budapest, Hungary; Pamela K. Whitman, Gates Mills, Ohio; Laszlo Balazs, Budapest, Hungary

[73] Assignee: General Electric Company, Schenectady, N.Y.

[ * ] Notice: This patent issued on a continued prosecution application filed under 37 CFR 1.53(d), and is subject to the twenty year patent term provisions of 35 U.S.C. 154(a)(2).

[21] Appl. No.: 08/855,655

[22] Filed: May 13, 1997

Related U.S. Application Data

[63] Continuation of application No. 08/503,672, Jul. 18, 1995, abandoned, which is a continuation of application No. 08/228,835, Apr. 18, 1994, abandoned.

[51] Int. Cl.[6] ..... H05B 31/02

[52] U.S. Cl. ..... 315/248; 315/56; 315/71; 315/58

[58] Field of Search ..... 313/485, 486, 313/489, 492, 639, 634; 315/56, 248, 71, 70, 57, 58

[56] References Cited

U.S. PATENT DOCUMENTS

| | | | |
|---|---|---|---|
| 2,899,583 | 8/1959 | Macksoud | 313/485 |
| 3,504,819 | 4/1970 | Veres | 313/485 |
| 3,886,396 | 5/1975 | Hammer et al. | 313/486 |
| 3,987,331 | 10/1976 | Schruers | 313/486 |
| 4,088,802 | 5/1978 | Shriver, Jr. | 427/62 |
| 4,119,889 | 10/1978 | Hollister | 313/485 |
| 4,336,479 | 6/1982 | Kodama et al. | 313/487 |
| 4,340,512 | 7/1982 | Shreurs | 523/122 |
| 4,352,043 | 9/1982 | Rigden | 310/1 |
| 4,797,594 | 1/1989 | Sigai et al. | 313/488 |
| 4,924,141 | 5/1990 | Taubner et al. | 313/488 |
| 5,105,122 | 4/1992 | Koning et al. | 313/485 |
| 5,109,180 | 4/1992 | Boultinghouse et al. | 313/317 |

*Primary Examiner*—Robert Pascal
*Assistant Examiner*—Michael Shingleton
*Attorney, Agent, or Firm*—Pearne, Gordon, McCoy & Granger LLP

[57] ABSTRACT

An electrodeless fluorescent reflector lamp includes a housing arrangement having a threaded screw base for receiving line power and a lamp envelope mounted on the housing arrangement. A ballast circuit is disposed within the housing arrangement and is effective for converting line power into an RF signal which excites a fill contained within the lamp envelope to a discharge state thereby resulting in the production of visible light. The lamp envelope is constructed having an upper curved face portion and a lower tapered portion which extends partly within the housing. A reflective coating is applied to the lower tapered portion of the lamp envelope. A phosphor coating distribution is applied to the interior surface of the lamp envelope in a manner so as to maximize the light output from the reflector lamp. The phosphor coating distribution is such that a first thickness of phosphor material is disposed on the lower tapered portion whereas a second thickness of phosphor material is applied to the upper curved face portion of the lamp envelope. The thickness of the phosphor material applied to the lower tapered portion is substantially greater than that applied to the upper curved face portion thereby resulting in improved light output characteristics for the reflector lamp.

13 Claims, 4 Drawing Sheets

Fig. 4(a)
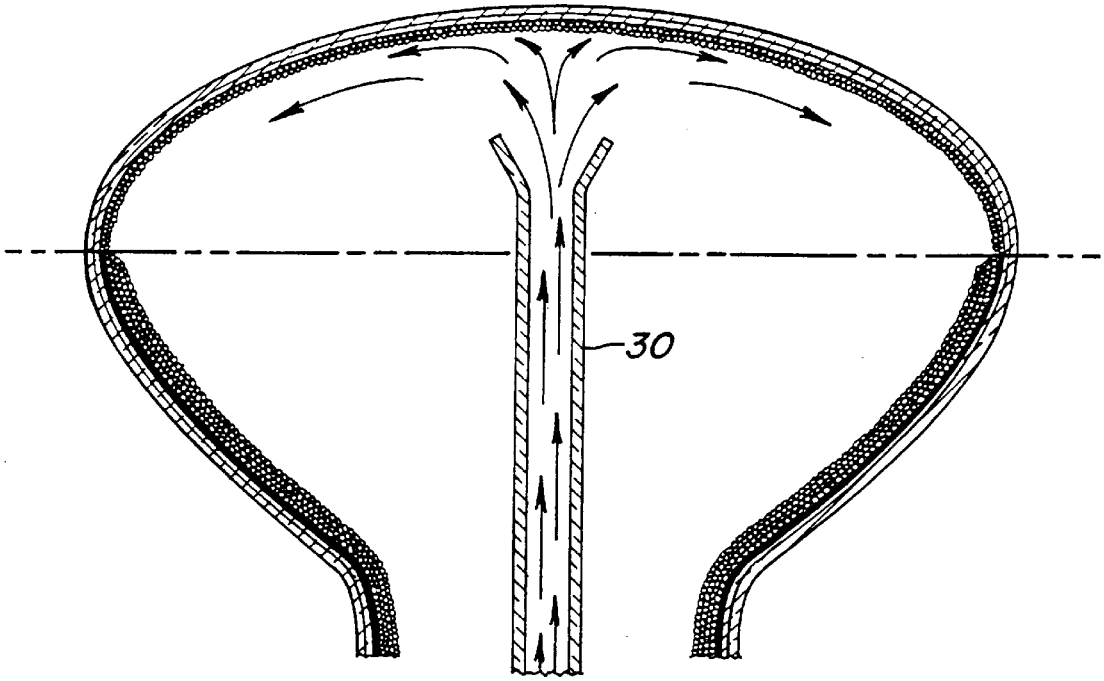
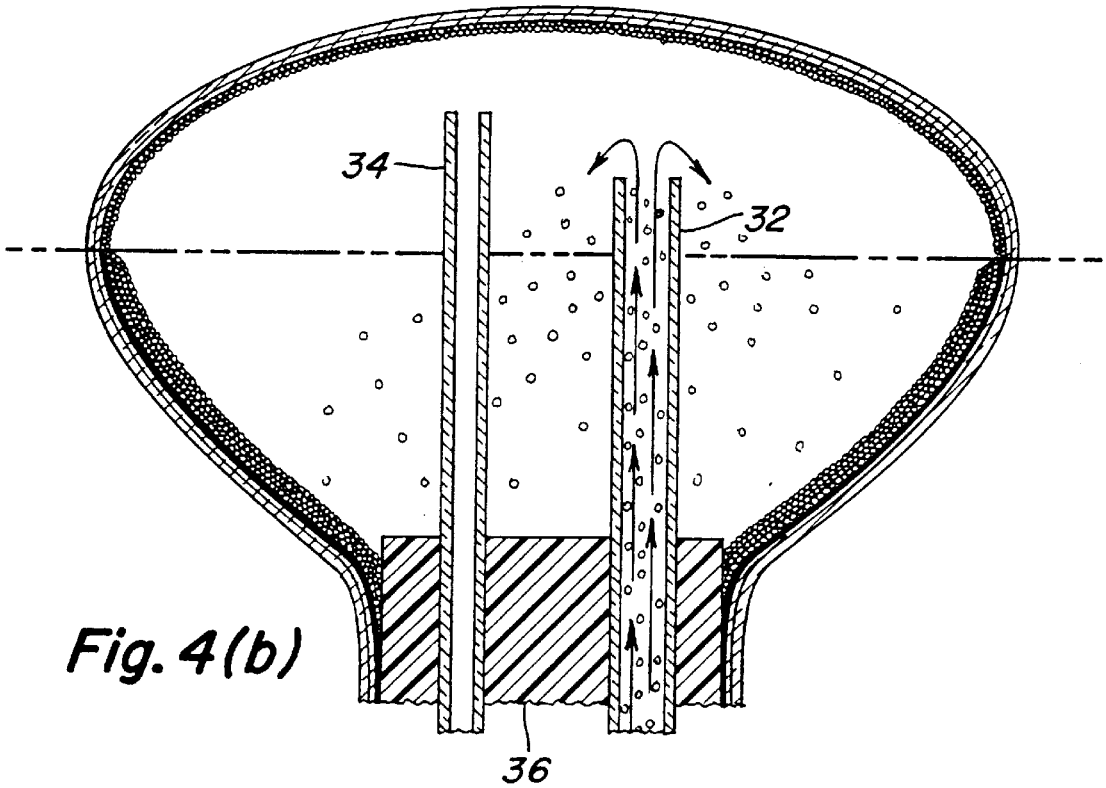
Fig. 4(b)

ELECTRODELESS FLUORESCENT LAMP HAVING AN IMPROVED PHOSPHOR DISTRIBUTION ARRANGEMENT AND A METHOD OF MAKING THE SAME

This is a continuation of application Ser. No. 08/503,672, filed Jul. 18, 1995 now abandoned, which is a continuation of application Ser. No. 08/228,835, filed Apr. 18, 1994 now abandoned.

FIELD OF THE INVENTION

This invention relates to an electrodeless fluorescent lamp having an improved phosphor coating/distribution arrangement associated therewith. More, particularly, this invention relates to such a lamp and coating/distribution arrangement as can be configured as a reflector type of lamp and which is phosphor coated in such a way as to maximize the light output therefrom.

BACKGROUND OF THE INVENTION

Compact fluorescent lamps have been finding greater acceptance in both consumer and commercial lighting applications primarily because of their improved energy efficiency relative to conventional incandescent lamps and because of their longer life expectancy over the standard incandescent line of products. Though such products have been available in the marketplace for many years, early generation compact fluorescent lamps had suffered from certain deficiencies such as overall size and weight. These deficiencies have been eliminated recently by the introduction of shorter profile lamp envelopes that more readily fit within typical light fixtures and by the use of lighter, more compact electronic ballast circuits in place of conventional magnetic ballasts. One problem that remains to be solved is that of incorporating the increased life expectancy and energy efficiency of compact fluorescent lamps into a reflector type of lamp that is used extensively in recessed lighting and display lighting for instance. Presently, when a compact fluorescent lamp is combined with a reflector housing to achieve an efficient reflector lamp product, the overall size of such device is so large as to make this lamp impractical for most recessed lighting fixtures.

In addition to the need to improve the size and performance properties of a compact fluorescent version of a reflector lamp, to further improve the life expectancy of the compact fluorescent lamps in general, it has been proposed to provide an electrodeless version of a compact fluorescent lamp which could then apply to the reflection version thereof. By removing the electrodes from within the lamp envelope and exciting the discharge therein by means of an RF signal, the life expectancy can be increased significantly due to the elimination of a glass to metal seal around the electrodes and further due to the fact that ion emissions associated with the electrodes can be eliminated. An example of an electrodeless fluorescent lamp having an A-line configuration can be found in U.S. Pat. No. 4,010,400 in which it is disclosed that an ionizable medium can be disposed in a lamp envelope and excited to a discharge state by introduction of an RF signal in close proximity thereto such that by use of a proper phosphor, visible light can be produced by such discharge. In order to generate this RF signal, a ballast circuit arrangement can be disposed in the lamp base, such ballast circuit arrangement including a resonant tank circuit which utilizes a coil member extending into the lamp envelope to inductively couple the RF signal to the ionizable medium.

As with any conventional fluorescent lamp, an electrodeless discharge lamp will have a phosphor layer coated on the inner surface of the lamp envelope which is effective so as to enable conversion of the discharge from the ionizable medium into visible light. As to the phosphor material, it is the typical practice in fluorescent lamp manufacture to use halophosphates which are relatively inexpensive and are used extensively because of their good efficacy, low cost and wide range of acceptable colors. Although use of the halophosphate materials is appropriate for larger fluorescent lamps such as the conventional 2 and 4 foot versions, in a compact fluorescent lamp application it is necessary to utilize comparatively more expensive rare earth phosphors. Given this fact, in order to achieve a cost effective replacement for a conventional incandescent type reflector lamp that utilizes electrodeless fluorescent technology, it would be advantageous if a coating arrangement could be developed that minimized the usage of the expensive rare earth phosphors in terms of the applied thickness of such materials.

In addition to the requirement of developing a phosphor coating arrangement that utilizes the rare earth phosphors in a cost effective manner, there is the requirement that for a reflector version of an electrodeless compact fluorescent lamp, a deposition of a reflector coating be applied in a manner that results in a maximum light output through the face region of the lamp envelope. Such an electrodeless fluorescent reflector lamp presents a special difficulty; that is, how to deposit the reflector coating in cooperation with the phosphor coating. It is known that finely divided titania can be used as the reflective material and can be applied to the lower portion of a lamp envelope which is shaped substantially like a conventional reflector lamp. The visible reflectivity of such coating should be as close to 1 as possible which would require a fairly thick coating of between 50–500 particle layers of the reflecting material.

It is not as straightforward to determine the coating thickness distribution of the phosphor material. For example, most aperture fluorescent lamps such as are used in reprographic equipment, have no phosphor coating on the window; such window as would correspond to the face region of a reflector lamp. This has the disadvantage that UV radiation emitted by the discharge is absorbed by the glass without being converted to visible light.

Alternatively, the phosphor coating can be applied to the entire interior surface of the lamp envelope to ensure maximum conversion to visible light. Using conventional techniques, this could be accomplished by filling the lamp envelope with a suspension containing the phosphor powder and then draining or alternatively, flushing a suspension into the lamp envelope. Either method will give a phosphor coating weight distribution which is thicker on the face and thinner on the lower region of the envelope due to the characteristics of gravity induced draining. Typically, when the suspension used is thick enough to produce a good phosphor coating for absorbing UV, the coating on the face is so thick that it actually reflects visible light. By reflecting visible light from the face region of a reflector lamp, a significant amount of light is trapped within the lamp and will undergo multiple reflections causing light loss. Furthermore, a significant amount of trapped light is lost by absorption by mercury deposits, impurities, and transmission through the reflecting portions of the lamp. Accordingly, it would be advantageous if a phosphor coating weight distribution could be developed which would allow for efficient conversion of UV into light output yet would not be so thick as to reflect a significant amount of light back away from the face region of the envelope.

For a conventional electroded compact fluorescent application the development of a coating arrangement that varied the thickness would not be practical given the typical geometric configuration of the lamp envelope. Such limitation is not a factor in an electrodeless fluorescent lamp in general and a reflector version in particular however given that there is a variation in the diametric dimension of the lamp envelope in order to accommodate the re-entrant cavity. Accordingly, it would be possible to utilize a combination of varying thicknesses of the rare earth phosphors in order to achieve a reflector lamp that would be of a minimum size and would provide a maximum amount of light output.

One problem with providing a phosphor coating arrangement having varying thicknesses at different areas of the lamp envelope is in the implementation of a coating method which would be applicable to high speed automated manufacturing systems where it is necessary to provide for a high quality product having uniform physical characteristics for sales quantities projected to be in the millions of units. Moreover, it is also necessary that such manufacturing method achieve the end product in as simple and cost effective manner as possible without requiring the addition of costly equipment modifications to existing equipment presently used in the manufacture of fluorescent lamps. Accordingly, it would be advantageous if a manufacturing method could be developed that allowed for the implementation of the varying thickness phosphor coating of a reflector type lamp which utilized an electrodeless fluorescent lamp as the light source.

SUMMARY OF THE INVENTION

The present invention provides an electrodeless fluorescent reflector lamp having an improved phosphor distribution arrangement which allows achieving a maximum light output from the face of the reflector lamp and does so by means of a cost effective distribution arrangement for the phosphor materials used therein. Additionally, the present invention discloses a method for implementing such a phosphor distribution arrangement in a cost effective and production efficient manner. We have found through experimentation that light output is optimized when there is a certain phosphor thickness on the face region and a comparatively thicker phosphor thickness on the reflector region of the lamp envelope. Such experimentation has included calculations relating to the efficiency of the phosphor coating weight per unit area in converting UV to visible light and multiple (infinite) reflections of visible light inside the lamp. We have found that a thin coating of phosphor on the face region increases light output by 20% compared to having no phosphor coating, whereas a thick coating on this face region (consistent with the thickness on the reflector region) would decrease light output by 30%. As to the thickness of phosphor coating on the reflector region, we have found that increasing phosphor coating weight increases light output but should be increased only to the extent that the increased light output is cost effective in relation to the more expensive use of greater amounts of rare earth phosphors.

In accordance with the principles of the present invention, there is provided a reflector lamp having a housing and base configuration on which is mounted a lamp envelope having a cavity formed therein. A ballast circuit arrangement can be disposed within the housing and base configuration and is effective so as to receive line power and convert such line power into an RF signal. An ionizable fill contained within the lamp envelope is excited to a discharge state by introduction of the RF signal in close proximity thereto. The lamp envelope is shaped having a tapered lower portion which is mounted on the base and housing configuration, and a curved upper face portion extending from the lower tapered portion, together the tapered lower portion and the curved upper face portion forming a reflector shaped lamp envelope. A reflective coating such as a finely divided titania is applied to the inner surface of the tapered lower portion. A first phosphor coating having a first thickness associated therewith is disposed on the inner surface of the tapered lower portion whereas a second phosphor coating is disposed on the inner surface of the curved upper face portion of the lamp envelope. The first thickness of phosphor coating is substantially greater in dimension than the second thickness of phosphor coating. An inner re-entrant cavity is formed in the lamp envelope and extends approximately centrally within the region associated with the lower tapered portion, the re-entrant cavity having a phosphor coating disposed thereon which is substantially the same thickness as the first phosphor coating of the lower tapered portion.

In order to practice the present invention, it would be possible to coat the entire inner surface of the lamp envelope then while draining, the coating on the face region is thinned by blowing moist air through a nozzle inserted in the lamp thus effectively blowing suspension off of the face region and onto the reflector region. An alternate arrangement would involve first coating the entire inner surface of the lamp envelope with a thin phosphor coating, allowing such first layer to dry, and then up-flushing a second suspension to the intersection between the face region and the reflector region. Once the second suspension has drained, a thicker coating weight of phosphor will reside on the reflector region.

BRIEF DESCRIPTION OF THE DRAWINGS

In the following detailed description, reference will be made to the attached drawings in which:

FIGS. 4(A) and 4(B) are elevational views in section of lamps illustrating two methods of achieving the phosphor coating arrangement of the present invention.

DETAILED DESCRIPTION OF THE INVENTION

Figure 1:
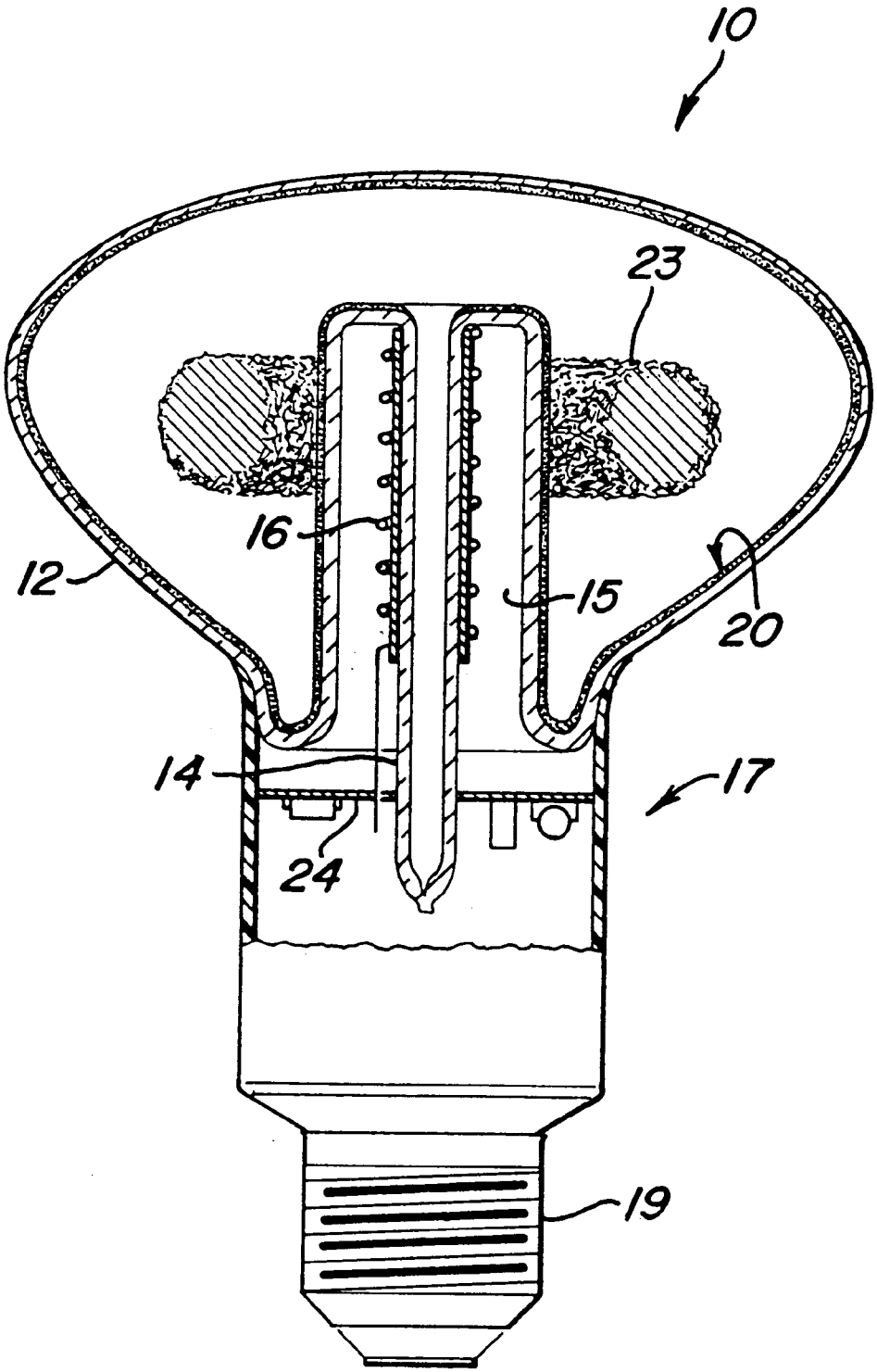
FIG. 1 is an elevational view in section of an electrodeless fluorescent reflector lamp constructed in accordance with the present invention.

As seen in FIG. 1, a reflector lamp 10 which utilizes electrodeless fluorescent light source technology includes a lamp envelope 12 which is mounted on a base and housing member 17. Formed in the lamp envelope 12 is a re-entrant cavity 15 which extends centrally from the bottom end of the lamp envelope 12. Also extending centrally within the re-entrant cavity 15 is an exhaust tube 14 which can extend into the base and housing member 17. A fill of mercury and a rare gas as is common in the fluorescent lamp arts, is contained within lamp envelope 12 and, when properly energized as will be discussed hereinafter, is excited to a discharge state as represented by toroidally shaped discharge 23. As will be further discussed relative to FIG. 2, a phosphor coating arrangement 20, as well as a reflector coating is applied to the inner surface of the lamp envelope 12 so as to enable the conversion of the discharge 23 into visible light and to direct such visible light externally of the reflector lamp 10 in a reflector lamp beam pattern.

To provide for the energization of the fill contained within lamp envelope 12, an electronic ballast circuit arrangement 24 is disposed within base and housing member 17. For a detailed understanding of an electronic ballast circuit arrangement for a compact fluorescent lamp such as illustrated in FIG. 1, reference is hereby made to U.S. patent application Ser. No. 08/020,275, filed on Feb. 18, 1993 by Nerone et al and assigned to the same assignee as the present invention, such application being herein incorporated by reference. Of course, it can be appreciated that the efficient phosphor coating arrangement of the present invention could also be utilized where the lamp is disposed separately from the ballast circuit arrangement. A coiled core portion 16 of the electronic ballast circuit arrangement 24 is disposed in surrounding relation to the exhaust tube 14 which extends centrally within the re-entrant cavity 15. The electronic ballast circuit arrangement 24 including the coiled core portion 16 is effective for generating an RF signal which, when introduced in close proximity to the fill contained within the lamp envelope 12, excites such fill to form the toroidal discharge 23. The electronic ballast circuit arrangement receives its power from a conventional power line input through a typical threaded screw base 19.

For a reflector lamp type of application, it is necessary that the coating arrangement be applied in a manner to insure the maximum amount of light output from the face portion of the lamp envelope 12. To this end, the electrodeless fluorescent lamp 10 of FIG. 1 is first coated with a conducting transparent film 26 of tin oxide doped with fluorine then a thin coating of a finely divided alumina to protect the conducting film. The conducting transparent film is utilized for the purpose of EMI suppression, the details of which can be found in U.S. Pat. No. 4,645,967. The finely divided alumina is also applied to the surface of the re-entrant cavity 15 for protection purposes. A reflective coating of a finely divided titania is applied over the bottom portion of the lamp envelope 12 and over the re-entrant cavity 15.

Figure 2:
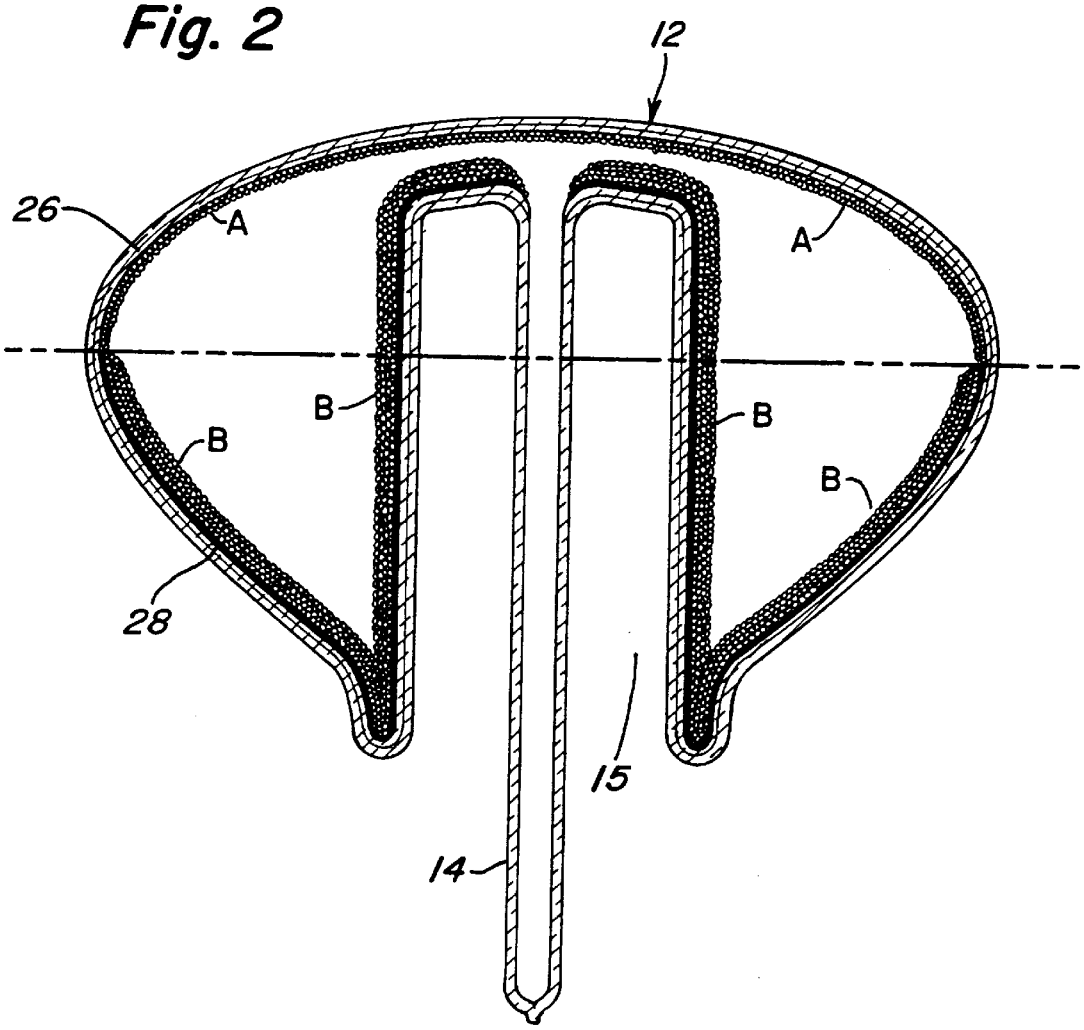
FIG. 2 is an elevational view in section of the lamp envelope portion of the lamp of FIG. 1 including the phosphor coating arrangement of the present invention.

As seen in FIG. 2, the lamp envelope 12 is divided by horizontal dashed line I—I into essentially two portions, the upper curved face portion 12*a*, and the lower tapered portion 12*b*, the finely divided titania which serves as the reflective coating is applied only to the lower tapered portion 12*b* and to the re-entrant cavity 15. In the present invention, the entire inside of the lamp envelope 12 is coated with a slurry containing the phosphor powder which converts the mercury UV radiation to visible light. In conventional phosphor coating practice, a phosphor slurry is applied either uniformly over the interior of the lamp envelope 12, or, after being applied, it is removed from the face or upper curved portion such as 12*a*, thereby creating a clear window as in the case of a fluorescent aperture lamp.

In contrast to the practice of providing the same phosphor coating arrangement over the entire surface of the lamp or of removing the phosphor coating entirely from the face portion of the lamp, the present invention provides for an arrangement of a distribution of phosphor coating weight at certain portions of the lamp envelope 12 thereby resulting in a higher light output from the reflector lamp 10 of FIG. 1. Specifically, the present invention provides a reflector lamp having a significantly higher visible light output compared to a similar lamp phosphor-coated in one of the mentioned conventional manners. As seen in FIG. 2, this significantly higher light output is achieved by means of the use of a relatively thin coating of phosphor material designated as coating thickness A which is applied to the upper curved portion 12*a* of the lamp envelope 12, and a thicker coating of phosphor material, designated coating thickness B, which is applied to the tapered lower portion 12*b* of the lamp envelope 12. Although described in terms of separate coating thicknesses, it should be understood that the thicker coating on the lower portion can be achieved by use of a first coating over the entire interior surface then a second coating over only the bottom portion. Thus, the thicker coating is actually a combination of the first thin coating and a second coating.

In accordance with the teachings of the present invention, it has been determined that the visible reflectivity property of the phosphor coating A applied to the upper curved portion 12*a*, should be between 25 and 63%. It should be understood that this reflectance value represents an average reflectance value over the surface areas of the respective upper and lower portions of the lamp envelope. By use of a value in this range, the UV radiation emitted by discharge 23, can be converted to visible light by phosphor coating A, while still assuring that light generated by the phosphor coating B applied to the reflector portion, or the lower tapered portion 12*b* of lamp envelope 12, can escape through the curved upper portion 12*a*. For phosphors with particle sizes of approximately 5 micrometers, and densities of around 5 grams/cm$^3$, this corresponds to a coating weight density of 0.8–2.8 mg/cm$^2$ applied to the upper curved portion 12*a* of lamp envelope 12.

As to the phosphor coating B disposed on the lower tapered portion 12*b* of the lamp envelope 12, it has been determined that the visible reflectivity property of such coating should be in excess of approximately 70% and should have corresponding coating weights of at least 4.0 mg/cm$^2$. As will be discussed relative to FIG. 3, it would be preferable to provide a coating weight of between 5 and 7.5 mg/cm$^2$ on the lower tapered portion 12*b* of the lamp envelope 12. This range of values would insure that all UV radiation striking the reflector surface 28 will be converted to visible light and much of the visible light would be reflected by the phosphor coating itself.

Figure 3:
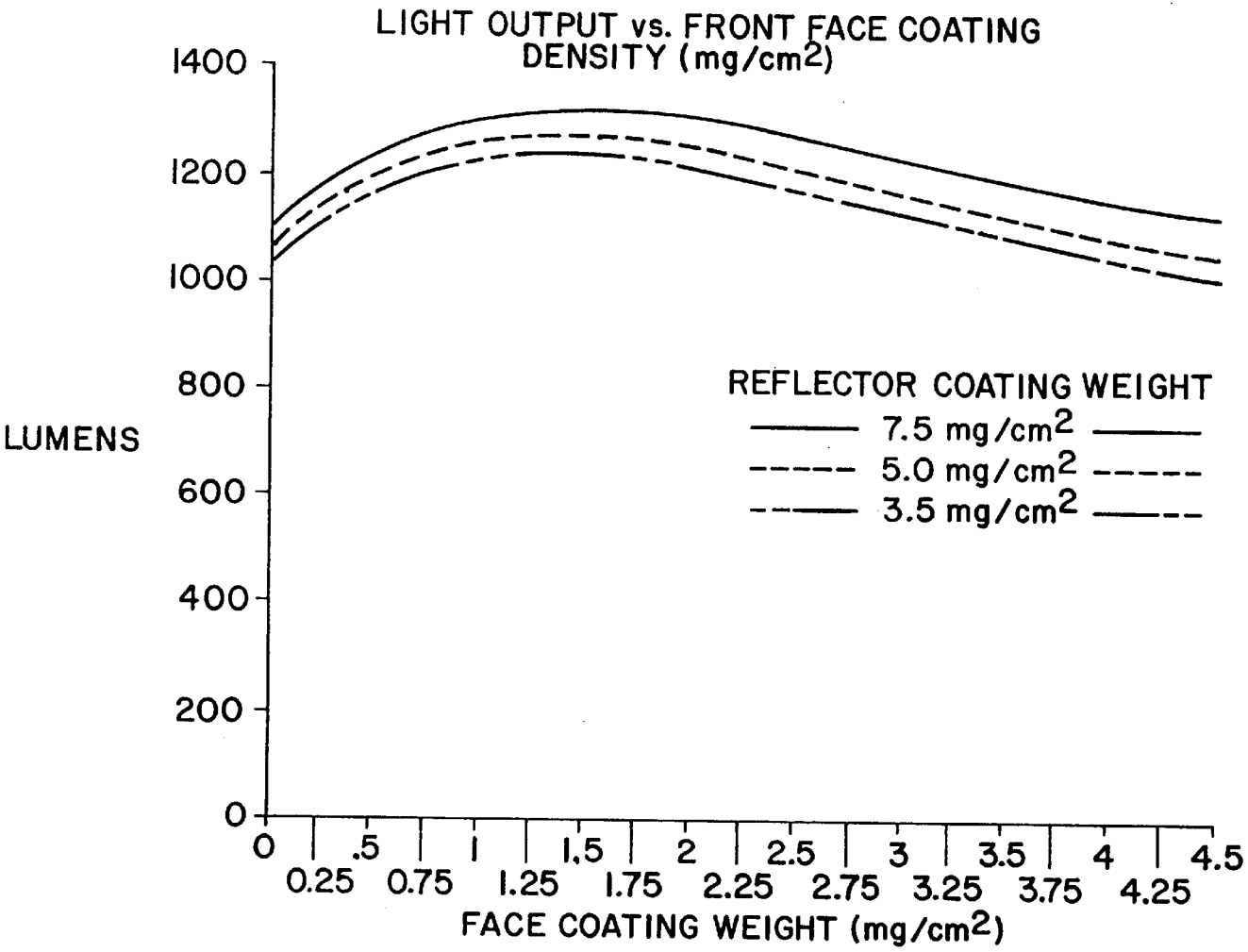
FIG. 3 is a graphical representation of the lumen output versus face coating weight for various values of reflector coating weights.

As seen in FIG. 3, a graph of the light output versus the coating weight for the phosphor coating A disposed on the upper curved portion 12*a* of the lamp envelope 12, is plotted for various values of the coating weight of phosphor coating B disposed on the lower tapered portion 12*b*. It can be seen that for the highest level of light output, that is, in the region above 1200 lumens, a phosphor coating weight of less than 2.5 mg/cm$^2$ is required on the upper curved portion 12*a* along with a phosphor coating weight of greater than approximately 5.0 mg/cm$^2$ on the lower tapered portion 12*b* of the lamp envelope 12. In actual practice, for a lamp envelope 12 having a phosphor coating weight A on upper curved portion 12*a* of between 1.0 and 2.0 mg/cm$^2$ and a phosphor coating weight B on lower tapered portion 12*b* of approximately 7.5 mg/cm$^2$, lumens were measured in excess of 1310 lumens of light output as compared to measured values of less than 1100 lumens output when the phosphor coating weight A was 3.5 mg/cm$^2$ and the phosphor coating weight B was between 3.5 and 4.5 mg/cm$^2$. It should be understood that the graph of FIG. 3 illustrates an economic tradeoff in terms of the amount of phosphor material used to achieve the desired lumen output by virtue of the curve of the plots. For instance, at a reflector coating weight of 7.5 mg/cm$^2$ and a value of 1250 lumens, such output can be achieved at a face coating weight of approximately 0.75 mg/cm$^2$ (left of peak lumen value) and at a value of approximately 2.75 mg/cm$^2$ (right of peak lumen value). It is contemplated that both such values, regardless of the economic tradeoff involved, are within the scope of the present invention.

It should be understood that the term "thickness" as used herein is a relative term and is intended only to describe the reflective properties of the phosphor material. Accordingly, since different phosphor materials have different densities and particle sizes associated therewith, a substitution of a smaller size particle structure, although it may be thinner in terms of the actual physical dimensions of such phosphor coating relative to a coating which used a larger particle structure phosphor material, would still result in the same reflectance properties of the larger particle structure phosphor material. In fact, it may be possible to use a combination of small particle size phosphors and larger particle size phosphors so that the lower portion and upper portions of lamp envelope 12 have relatively comparable "thicknesses" of coating material. The controlling characteristic relates to the amount of reflectance that is associated with such phosphor material. The coating weight of the phosphor material can be achieved by means of using a blend of bi-phosphor or tri-phosphor materials as are commonly used on electroded compact fluorescent lamps. Additionally, it may be possible to satisfy the reflectance parameters of either the upper face coated region or the lower tapered portion by use of the more inexpensive halophosphate materials in conjunction with the rare earth phosphors. Regardless of the material used the coating weight on the lower tapered portion should achieve the relationship defined by:

$$W(\text{mg/cm}^2) > 3.5\times(1/15)\times\text{density (gm/cm}^3)\times\text{diameter (micrometers)} \quad \text{eq. (1)}$$

It should be understood that measurements of bulk particle average density are approximate. Additionally, particle size measurements depend on definition and the measuring device used. The average particle size (diameter) used herein is meant to be that determined from the mean cross-sectional area of the particles. For coating weights of phosphor material used on the face region of lamp 10, the following relationship applies:

$$0.7\times(1/15)\times\text{density (gm/cm}^3)\times\text{diameter (micrometers)} < W(\text{mg/cm}^2) < 2.4\times(1/15)\times\text{density}\times\text{diameter} \quad \text{(eq. 2)}$$

A method to measure the reflectance of phosphor coated on a curved lamp surface is to insert a small fiber optic bundle into the bulb at a fixed distance of 2 mm from the reflecting surface. For calibration, the reflectance of a freshly scraped, infinitely thick barium sulfate plaque is measured. The surface to be measured is illuminated by the fiber optic device utilizing a halogen lamp of controlled intensity. The light from the halogen lamp is filtered to pass only 400–700 nm radiation, with a peak at 550 nm. Other fibers in the bundle return the diffusely reflected light to a silicon photodetector.

In operation, to achieve the distribution of phosphor coating weights between coating weights A and B, there are two methods that have been utilized to practice the present invention as shown in FIGS. 4(A) and 4(B). One manufacturing method shown in FIG. 4(A) would be to displace some of the phosphor slurry from the upper curved portion 12*a* after the lamp envelope 12 has been coated but before the slurry has had a chance to dry. This can be accomplished by using a stream of moist air coming through a tube 30 that would be placed inside of the lamp envelope 12. In this manner, some of the phosphor coating on the upper curved portion 12*a* can be gently pushed off and this then drains down over the lower tapered portion 12*b* of the lamp envelope. An alternative method shown in FIG. 4(B) involves first coating the entire interior of the lamp envelope 12 with a relatively thin layer of phosphor coating, drying that first layer, and then upflushing a second coating of the phosphor material only over the lower tapered portion 12*b* of the lamp envelope 12 on which the reflective coating 28 is applied. Such up-flushing can be accomplished by use of a filling tube 32 and an exhaust tube 34 disposed at the open neck of the lamp envelope 12 and held by stopper 36.

Although the hereinabove described embodiments of the invention constitute the preferred embodiments, it should be understood that modifications can be made thereto without departing from the scope of the invention as set forth in the appended claims. For instance, it may be possible to increase the reflectance values of each of the phosphor coating weights. It is only necessary that the lower region of the lamp envelope have a higher reflectance value than that of the coating applied to the face region.

We claim:

1. An electrodeless fluorescent reflector lamp comprising a base and housing member, a lamp envelope mounted on said base and housing member, and a ballast circuit arrangement disposed within said base and housing member, said lamp envelope having a cavity formed therein, said lamp envelope having an inner surface, said ballast circuit arrangement being capable of receiving line power and converting said line power into a drive signal, said cavity containing a fill which is capable of being excited to a discharge state upon coupling said drive signal thereto, said lamp envelope being shaped having a lower portion which is located adjacent said base and housing member and a curved upper face portion extending from said lower portion, a non-light-generating reflective coating being provided adjacent said inner surface of the lower portion of the lamp envelope, a first thickness of phosphor coating being provided on said lower portion of said lamp envelope over said reflective coating, a second thickness of phosphor coating being provided adjacent the inner surface of said curved upper face portion, said first thickness being substantially greater than said second thickness, wherein said second thickness of phosphor coating comprises rare earth phosphors and has a reflectance of 25%–63% using 400–700 nm radiation with a peak at 550 nm and said first thickness of phosphor coating comprises rare earth phosphors and has a reflectance of more than 70% using 400–700 nm radiation with a peak at 550 nm.

2. The electrodeless fluorescent reflector lamp according to claim 1, wherein said first thickness of phosphor coating comprises rare earth phosphors and has a coating weight of at least 4 mg/cm$^2$.

3. The electrodeless fluorescent reflector lamp according to claim 1, wherein said second thickness of phosphor coating comprises rare earth phosphors and has a coating weight of 0.8 to 2.8 mg/cm$^2$.

4. The electrodeless fluorescent reflector lamp according to claim 2, wherein said second thickness of phosphor coating comprises rare earth phosphors and has a coating weight of 0.8 to 2.8 mg/cm$^2$.

5. The electrodeless fluorescent reflector lamp according to claim 1, wherein said second thickness of phosphor coating comprises rare earth phosphors and has a coating weight (in mg/cm$^2$) which (a) is greater than 0.7×(1/15)× density of phosphor material (gm/cm$^3$)×diameter of phosphor material (micrometers) and (b) is less than 2.4×(1/15)× density of phosphor material (gm/cm$^3$)×diameter of phosphor material (micrometers).

6. The electrodeless fluorescent reflector lamp according to claim 5, wherein said first thickness of phosphor coating comprises rare earth phosphors and has a coating weight (in mg/cm$^2$) which (a) is greater than 3.5×(1/15)×densityt of phosphor material (gm/cm$^3$)×diameter of phosphor material (micrometers).

7. The electrodeless fluorescent reflector lamp according to claim 4, wherein said first thickness of phosphor. coating has a coating weight of 5 to 7.5 mg/cm$^2$.

8. The electrodeless fluorescent reflector lamp according to claim 1, wherein said lamp envelope has a re-entrant cavity with an inner surface on the fill side of the envelope, and a phosphor coating having a thickness substantially the same as said first thickness is provided on the inner surface of the re-entrant cavity.

9. The electrodeless fluorescent reflector lamp according to claim 1, wherein said reflective coating is finely divided titania and wherein said drive signal comprises an RF signal.

10. The electrodeless fluorescent reflector lamp according to claim 1, wherein each of said first thickness of phosphor coating and said second thickness of phosphor coating are of the same composition.

11. The electrodeless fluorescent reflector lamp according to claim 2, wherein said lamp envelope has a bottom, said lamp envelope has a maximum width which defines a maximum circumference which defines a first plane, said lamp envelope has an upper portion between said first plane and said curved upper face portion, and said re-entrant cavity extends from the bottom of said lamp envelope through said first plane substantially into the upper portion of the lamp envelope.

12. The electrodeless fluorescent reflector lamp according to claim 3, wherein said second thickness of phosphor coating has a coating weight of 2.5 mg/cm$^2$.

13. The electrodeless fluorescent reflector lamp according to claim 3, therein said second thickness of phosphor coating has a coating weight of 1.0 to 2.0 mg/cm$^2$.

* * * * *